US007444909B2

(12) United States Patent
Repac et al.

(10) Patent No.: US 7,444,909 B2
(45) Date of Patent: Nov. 4, 2008

(54) DEVICE FOR CUTTING FRUIT AND VEGETABLES, IN PARTICULAR ONIONS

(76) Inventors: Cedomir Repac, Fliederweg 24, Brechen (DE) D-65611; Branko Culig, Marenticeva 6, Metlika (SI) 8330

( * ) Notice: Subject to any disclaimer, the term of this patent is extended or adjusted under 35 U.S.C. 154(b) by 0 days.

(21) Appl. No.: 11/320,631

(22) Filed: Dec. 30, 2005

(65) Prior Publication Data

US 2006/0101973 A1 May 18, 2006

Related U.S. Application Data

(62) Division of application No. 10/893,883, filed on Jul. 20, 2004.

(30) Foreign Application Priority Data

Feb. 18, 2004 (DE) ..... 20 2004 002 477 U

(51) Int. Cl.
*B26D 1/30* (2006.01)

(52) U.S. Cl. ..... 83/167; 83/597; 83/932

(58) Field of Classification Search ..... 83/932, 83/167, 857, 597
See application file for complete search history.

(56) References Cited

U.S. PATENT DOCUMENTS

| | | | | |
|---|---|---|---|---|
| 843,427 | A | 2/1907 | Atkinson et al. | |
| 1,379,724 | A | 5/1921 | Russell | |
| 1,614,282 | A | 1/1927 | Cleary | |
| 1,830,284 | A | 11/1931 | Massa | |
| 1,962,737 | A | 6/1934 | Gutman | 30/173 |
| 1,979,199 | A | 10/1934 | Haynes | |
| 2,219,963 | A | 10/1940 | Rieder | |
| 2,735,467 | A | 2/1956 | Hellmich | |
| 2,788,820 | A | 4/1957 | Hellmich | |
| 3,580,168 | A | 5/1971 | Zysset | 100/234 |
| 3,933,315 | A | 1/1976 | Popeil | |
| 4,100,676 | A | 7/1978 | Ferguson | |
| 4,383,365 | A | 5/1983 | Metzigian | |
| 4,466,346 | A | 8/1984 | Gemelli | 100/112 |
| 4,471,915 | A * | 9/1984 | Levin et al. | 241/37.5 |

(Continued)

FOREIGN PATENT DOCUMENTS

| | | |
|---|---|---|
| CH | 173667 | 2/1935 |

(Continued)

OTHER PUBLICATIONS

Drawing No. 169, entitled "Rezalnik cebule-169", dated Dec. 2, 1999.

(Continued)

*Primary Examiner*—Kenneth E. Peterson
(74) *Attorney, Agent, or Firm*—Charles P. Boukus, Jr.

(57) ABSTRACT

The invention relates to a device for cutting fruit and vegetables, in particular onions, having a cutter member (3) that has a plurality of blades (2) and having a counterpart element (4) against which the cutter member (3) is pressed for cutting the material to be cut, wherein the counterpart element (4) has a punch (5) which presses the material to be cut through the cutter member (3), or the blades (2) thereof. For receiving the cut material, a container (6) is releasably disposed on the cutter member (3), on its side remote from the counterpart element (4), in the region of the blades (2).

29 Claims, 7 Drawing Sheets

U.S. PATENT DOCUMENTS

Figure 1:
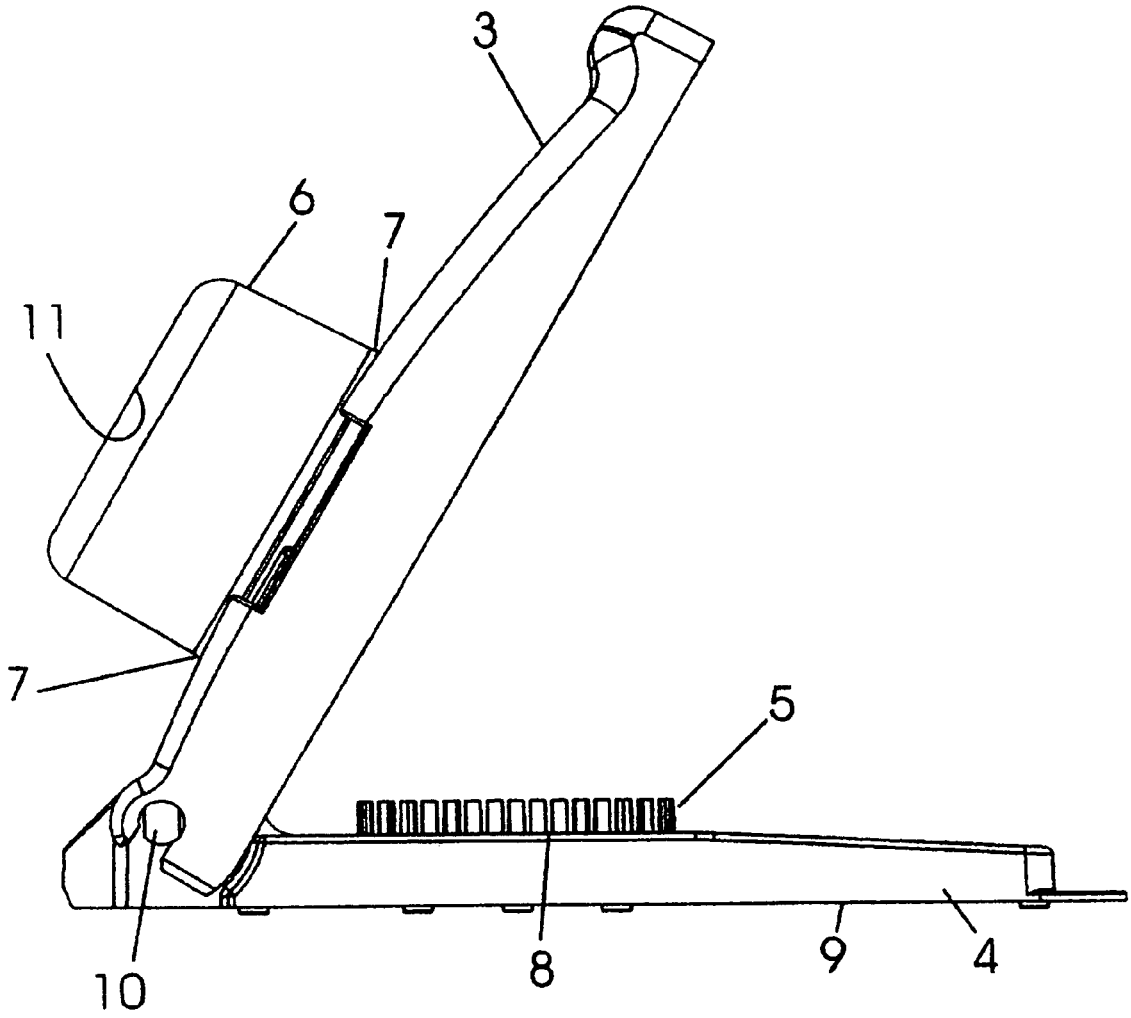

| | | | | |
|---|---|---|---|---|
| 4,625,404 | A | 12/1986 | Valente et al. | |
| D298,720 | S | 11/1988 | Bolduc et al. | D7/666 |
| 4,852,256 | A | 8/1989 | Schoettler | |
| 4,892,233 | A * | 1/1990 | Zelickson | 222/226 |
| 5,245,902 | A | 9/1993 | Pereira | |
| 5,337,480 | A | 8/1994 | Codikow | |
| 5,513,562 | A | 5/1996 | Moor | 100/112 |
| 5,692,424 | A | 12/1997 | Wallace | |
| 6,148,704 | A | 11/2000 | Lewis | |
| 6,805,032 | B2 | 10/2004 | Engdahl | |
| D499,615 | S | 12/2004 | Nordgren | D7/674 |
| 2003/0126968 | A1 | 7/2003 | Baddepudi | |

FOREIGN PATENT DOCUMENTS

| | | | |
|---|---|---|---|
| CN | 86 2 05709 | U | 2/1987 |
| CN | 2495238 | Y | 6/2002 |
| DE | 446941 | | 7/1927 |
| DE | 514114 | | 12/1930 |
| DE | 626248 | | 2/1936 |
| DE | 663269 | | 8/1938 |
| DE | 816138 | C | 8/1951 |
| DE | 1755940 | U | 8/1957 |
| DE | 1816018 | | 8/1960 |
| DE | 3112824 | A1 | 10/1982 |
| DE | 89 04 189.5 | U1 | 9/1989 |
| EP | 1410883 | A | 4/2004 |
| FR | 747115 | | 6/1933 |
| FR | 767729 | | 7/1934 |
| FR | 2670425 | | 6/1992 |
| GB | 417975 | | 10/1934 |
| GB | 467356 | | 6/1937 |
| GB | 670925 | | 4/1952 |
| GB | 2286110 | A | 8/1995 |
| GB | 2312613 | | 11/1997 |
| JP | 36-2584 | | 2/1961 |
| JP | 39-13488 | | 5/1964 |
| JP | 40-3262 | | 1/1965 |
| JP | 47-33086 | | 12/1972 |
| JP | 48-88669 | | 10/1973 |
| JP | 50-9866 | B | 4/1975 |
| JP | 51-119585 | A | 10/1976 |
| JP | 55-98596 | | 7/1980 |
| JP | 57-75843 | | 5/1982 |
| JP | 59-192495 | A | 10/1984 |
| JP | 64-16295 | | 1/1989 |
| JP | 1-271194 | A | 10/1989 |
| JP | 2-3397 | | 1/1990 |
| JP | 9-206227 | | 8/1997 |
| JP | 2002-66985 | | 3/2002 |
| WO | WO 02/064331 | A1 | 8/2002 |

OTHER PUBLICATIONS

Notification of Transmittal dated Feb. 8, 2007 and International Preliminary Report on Patentability in PCT International Application No. PCT/EP2004/011309.

Declaration of Linda Reichert dated Feb. 21, 2008 and Photographs 1/2 & 2/2.

Declaration of Linda Reichert dated Mar. 8, 2008 with attachments 1/4-4/4.

Eidesstattiche Versicherung of Cedomir Repac dated Mar. 20, 2008 with attachments 1/4-4/4 including English translation.

Eidesstattiche Versicherung of Milan Repac dated Mar. 20, 2008 with attachments 1/4-4/4 including English translation.

Eidesstattiche Versicherung of Horst Stengel dated Mar. 20, 2008 with attachments 1/4-4/4 including English translation.

Eidesstattiche Versicherung of Branko Culig dated Mar. 20, 2008 with attachments 1/4-4/4 and attached Drawing No. 156 including English translation.

Eidesstattiche Versicherung of Wolfgang Siebert dated Mar. 20, 2008 with attachments 1/4-4/4 including English translation.

* cited by examiner

DEVICE FOR CUTTING FRUIT AND VEGETABLES, IN PARTICULAR ONIONS

This application is a division of U.S. patent application Ser. No. 10/893,883 filed Jul. 20, 2004.

SPECIFICATION

The invention relates to a device for cutting fruit and vegetables, in particular onions, having a cutter member that has a plurality of blades and having a counterpart element against which the cutter member is pressed for cutting the material to be cut, wherein the counterpart element has a punch which presses the material to be cut through the cutter member, or the blades thereof.

An onion chopper of this kind is known for instance from International Patent Disclosure WO 02064331 A1, with a boardlike cutter element and a counterpart element, likewise embodied on the order of a board, that receives the onion to be cut. For cutting an onion, the cutter element is pivoted upward from the counterpart element that rests on an underlying support, and the onion to be cut is placed on a punch located on the counterpart element. After that, the cutter element is pivoted back onto the counterpart element, exerting a pressure, until the blades plunge into corresponding indentations on the punch. In the process, the onion is cut apart by the cutting grid of the cutter element and by means of the punch is pressed all the way through the cutting grid. Once the cutter element rests on the counterpart element, the material that has been cut is located on the top side of the cutter element and can be removed from the cutter element, for instance with the aid of a knife.

A disadvantage of this device is that pieces of the cut onion can drop unintentionally from the top side of the cutter element, for instance onto the floor. This often occurs when onions are being cut, since because of their oval shape the onion tends to fall apart after being cut.

A further disadvantage in this device is that the essential oils of the onion can develop freely after the cutting, causing the well-known irritation to the eyes of the user. It is also necessary to remove the cut onion from the top side of the cutter element when further onions are to be cut.

Furthermore, cleaning the punch proves difficult, since the essential oils of the onion can collect in the indentations in the punch, and the counterpart element can be cleaned only together with the punch.

It is therefore the object of the invention to further develop a device for cutting fruit and vegetables, in particular onions, having the characteristics recited at the outset, in such a way that while overcoming these disadvantages, handling of the device is improved substantially.

This object is attained by a device having the characteristics recited at the outset, in which for receiving the cut material, a container is releasably disposed on the cutter member, on its side remote from the counterpart element, in the region of the blades.

By means of the invention, it is attained that the cut onions, for instance, after being cut are received in the container and are secured against falling out. Also, the essential oils of a cut onion, for instance, cannot develop their eye-irritating effect, since they are essentially locked away from the environment by the container. Moreover, the container according to the invention offers the advantage that a plurality of kinds of material to be cut can be cut in succession, without requiring that the already-cut material be removed from the device and placed in a separate container. Once the desired quantity of vegetables, onions and the like has been cut, the device of the invention is simply turned over, so that the receiving container is now underneath the cutter element. The container is then released from the device, whereupon the cut material is held in the container and can be kept ready for further processing. In order here as well to suppress the irritating effect of the essential oils of a cut onion, a separate cap for closing the container once it has been released from the device may be provided. The cut material can then be stored in the container in airtight fashion until it is further processed.

In a first advantageous embodiment of the invention, the container is retained releasably on the cutter element by means of a bayonet mount. Alternatively, however, it is possible to use a screw closure or a detent connection. All these means assure fast, simple release of the container from the cutter element and its fastening to it.

To enable monitoring the fill level inside the container, in an embodiment of the invention the container comprises transparent material.

In a further concept of the invention, the punch is releasably held on the counterpart element, so that after use the punch can be released from the counterpart element and subjected separately to intensive cleaning. This is especially applicable whenever the cut material releases eye-irritating essential oils that can stick to the punch.

In this respect as well, for simple, fast release of the punch from the counterpart element and securing it to the counterpart element, it is provided that the punch is releasably disposed on the counterpart element by means of a bayonet mount. Screw closures but in particular detent connections are preferably employed.

To prevent the punch, in the cutting of the material to be cut and in particular when detent connections are used between the punch and the material, from being released unintentionally from the counterpart element by the pressure exerted on the material to be cut, the punch can be disposed in captive fashion on the counterpart element by means of fastening elements.

It has proved advantageous that the fastening elements have at least one clamping means that can be secured to the counterpart element and the punch by means of screws or similar fastening means.

In another especially advantageous embodiment of the invention, the blades form a cutting grid. As a result, the material to be cut is cut into small block-shaped pieces, which in the case of onions, for instance, because of their shell-like structure, fall apart into more or less small pieces or cubes of onion. In this respect only one cutting operation is required to obtain cut material that is cut as small as possible. In that case, the punch on the counterpart element should have a likewise gridlike structure of its indentations that the cutting grid engages.

In a further advantageous embodiment of the invention, the cutter element and the counterpart element are supported pivotably on one another. Since the cutter element acts as a lever, the expenditure of force in cutting is reduced considerably.

To assure simple, thorough cleaning of the individual parts of the device of the invention, it is provided that the cutter element and the counterpart element are likewise releasably joined together.

In still a further concept of the invention, both the counterpart element and the cutter element are embodied in boardlike fashion, which simplifies handling of the device substantially.

It is furthermore provided that blades are retained in a frame disposed releasably on the cutter element. As a result, the blades can easily be released from the cutter element and subject to thorough cleaning. The blades can also be replaced easily, if they should have become dull after long use.

Further characteristics, advantages, embodiments and possible applications of the present invention will become apparent from the ensuing description of one exemplary embodiment in conjunction with the drawings. All the characteristics described and/or shown in the drawing are the subject of the present invention on their own or in arbitrary appropriate combination, including independently of how they are summarized in the claims or the claims dependencies.

Figure 2:
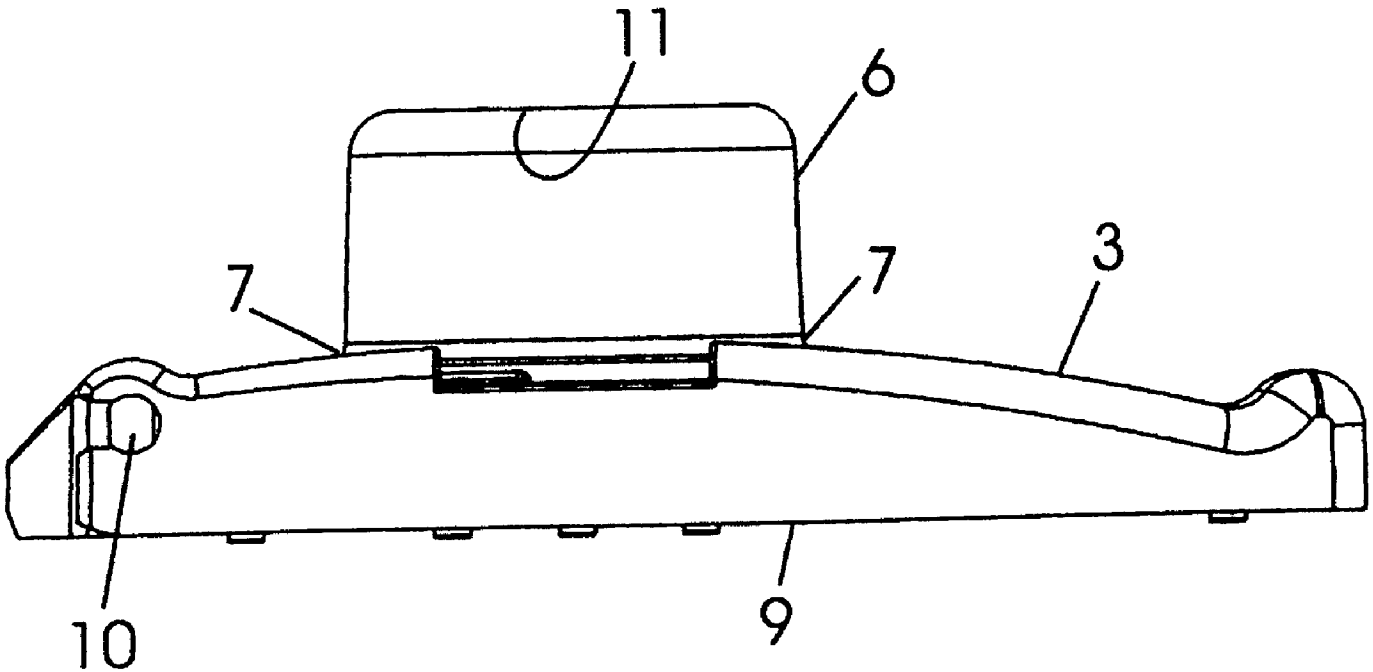
Figure 3:
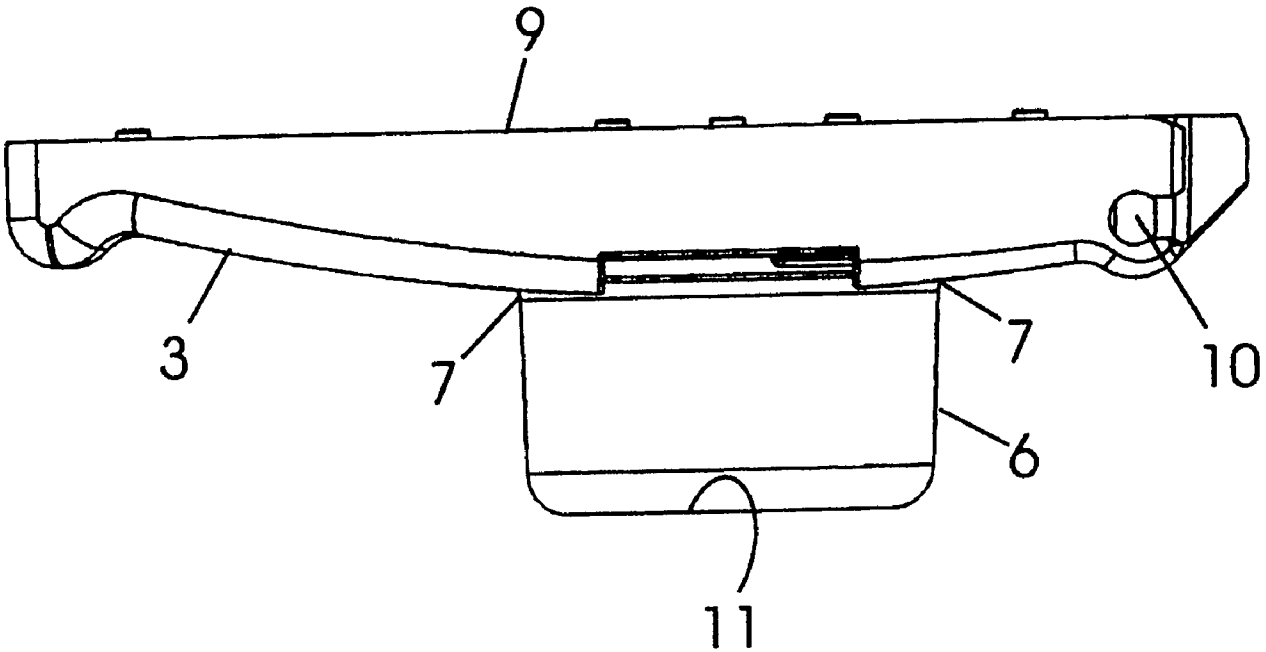
Figure 4:
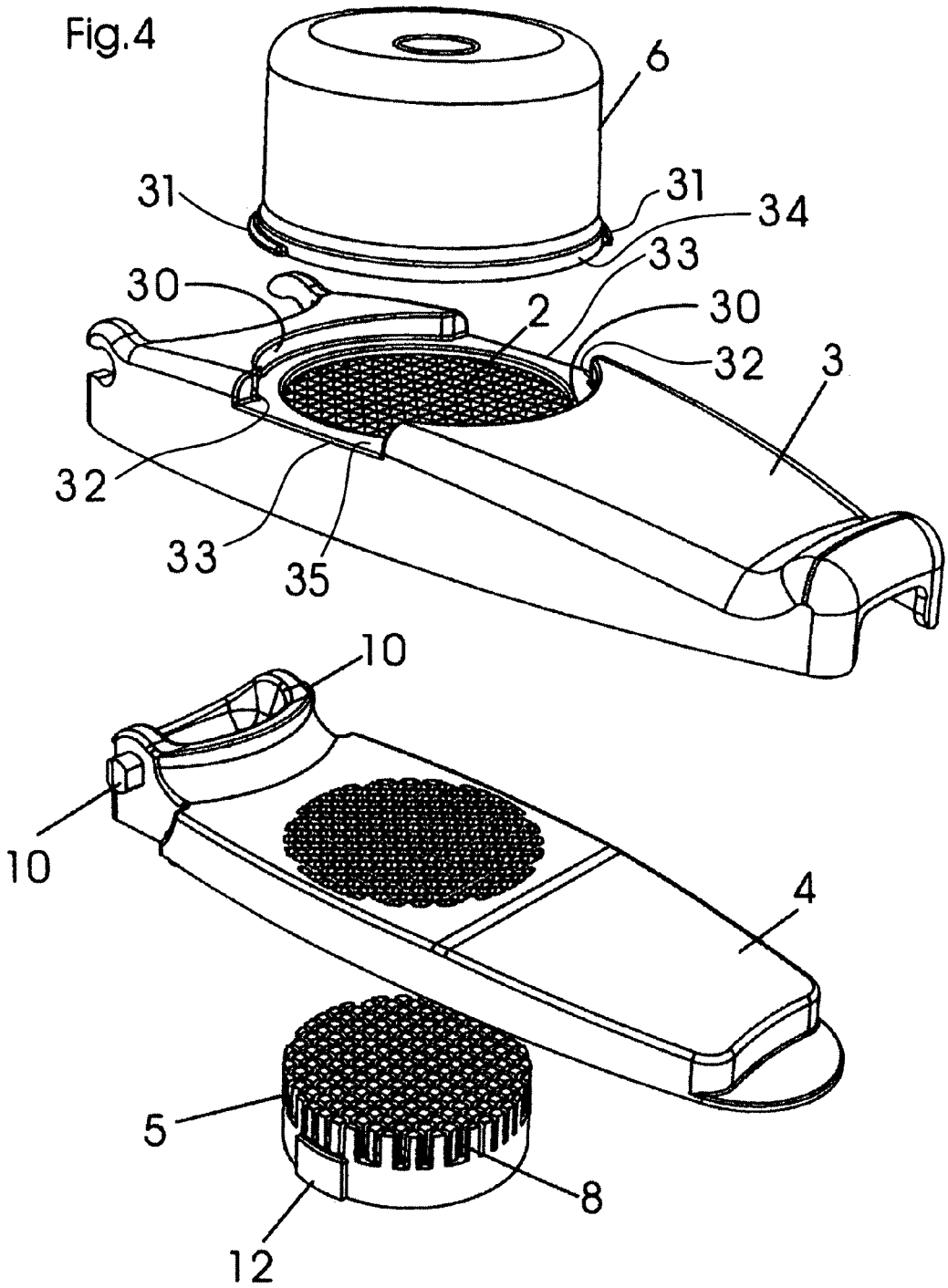
Figure 5:
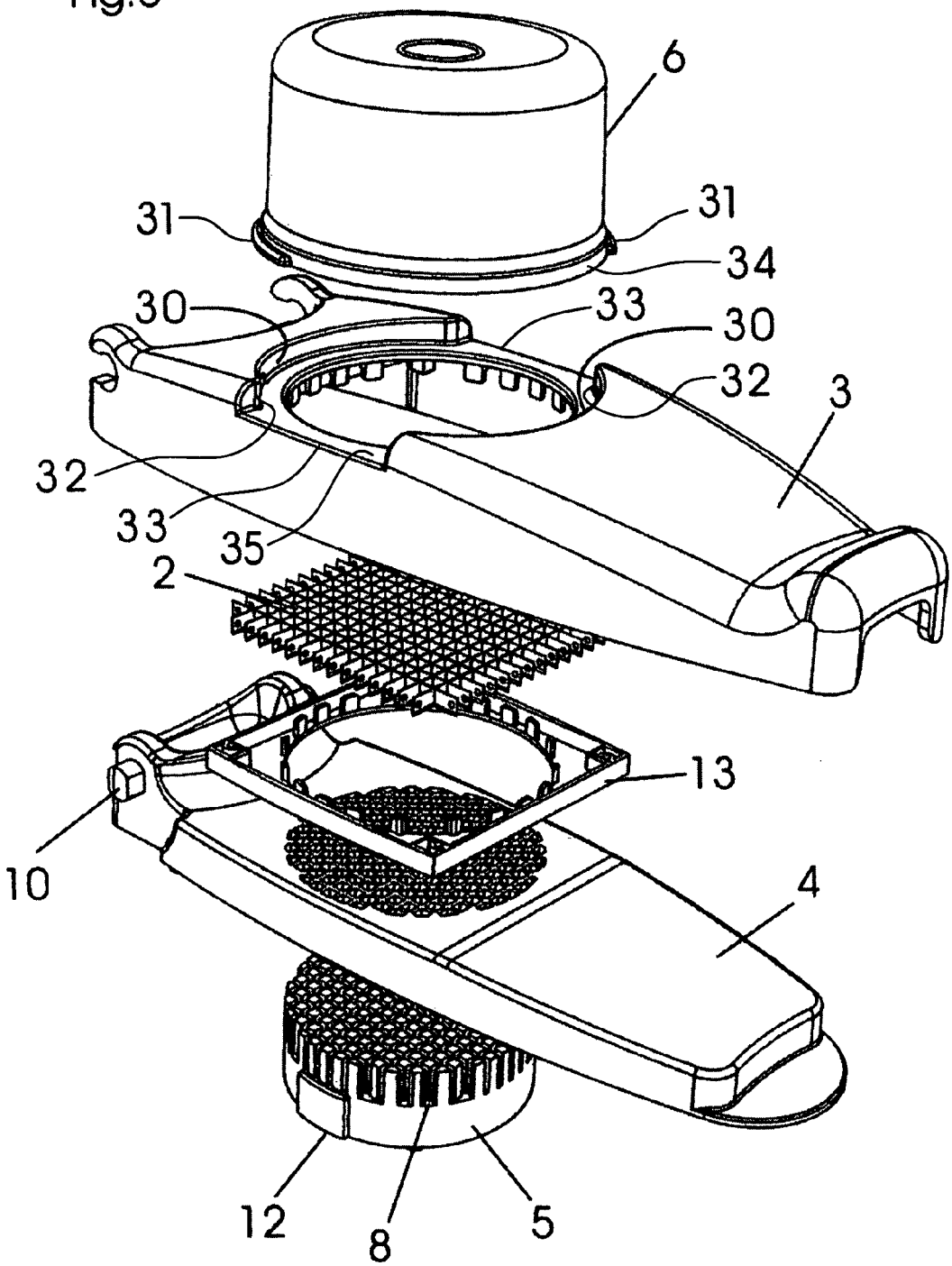
Figure 6:
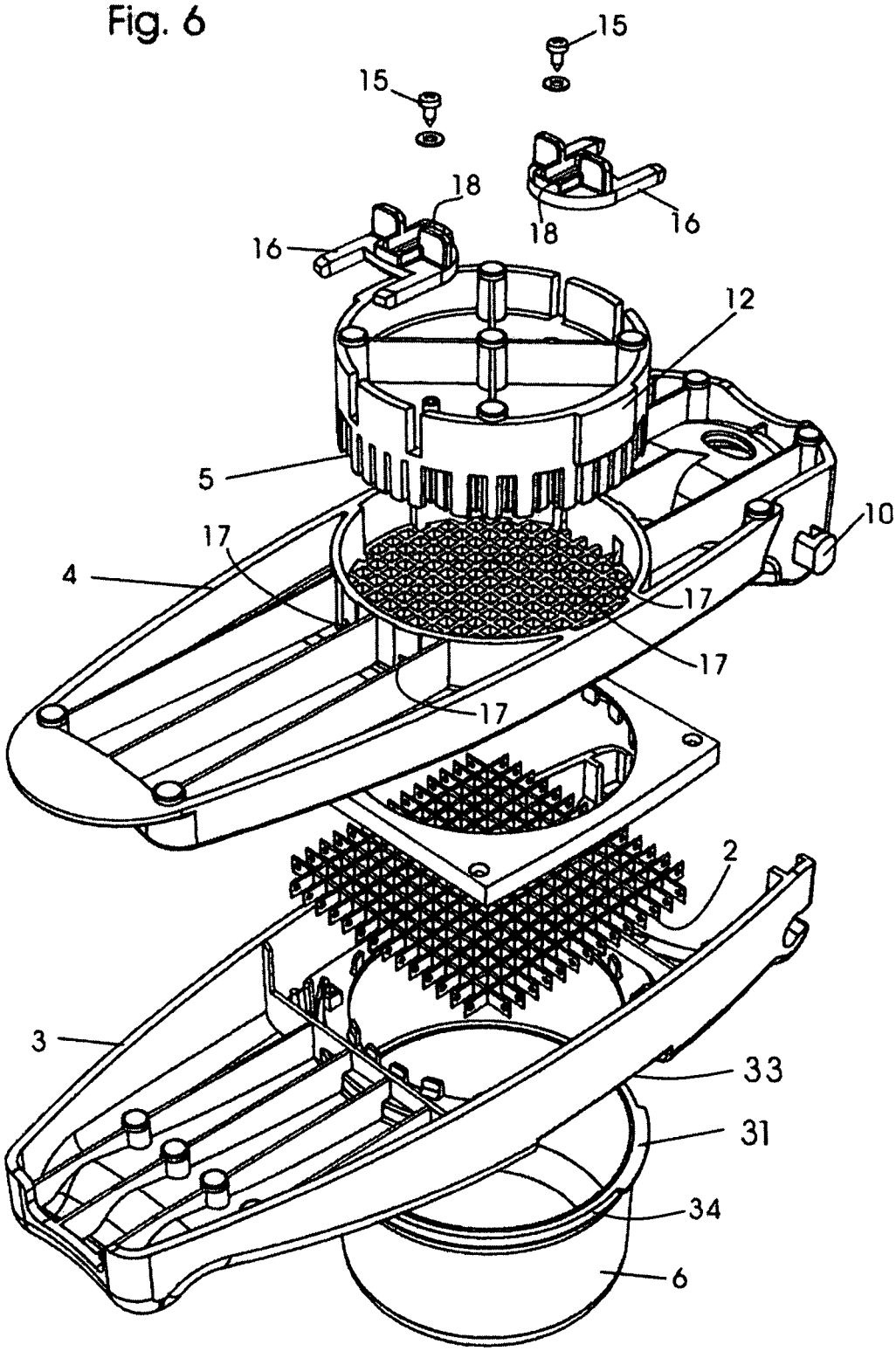
Figure 7:
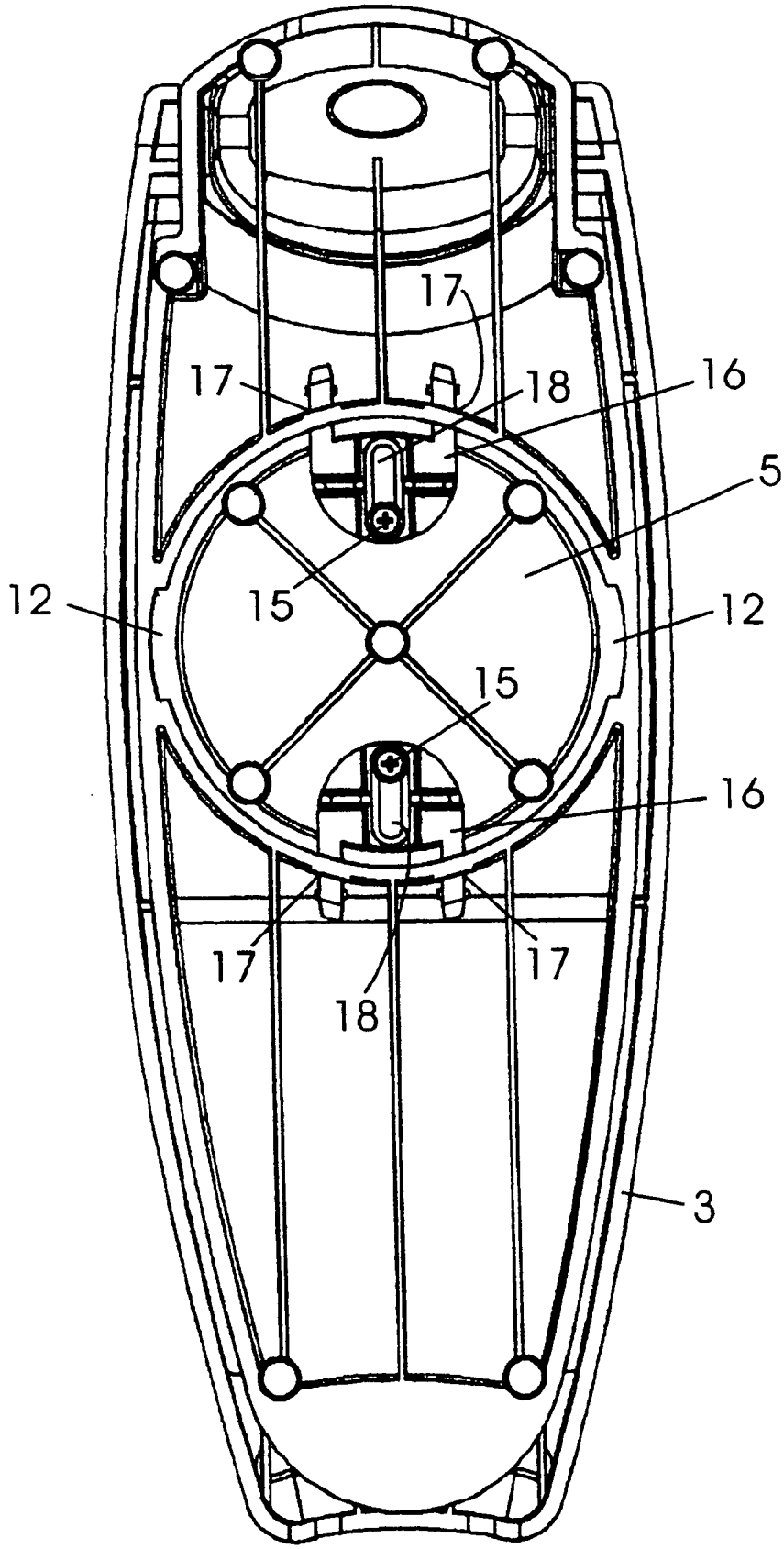

Shown are:

FIG. 1, one possible embodiment of a device according to the invention with a cutter element and counterpart element pivotable counter to one another;

FIG. 2, the device of FIG. 1, with the cutter element resting on the counterpart element;

FIG. 3, the device of FIGS. 1 and 2, after the material to be cut has been cut and before the container that receives the cut vegetables or onions is released;

FIG. 4, an exploded view in perspective of the device of FIGS. 1-3, with a releasable punch; and FIG. 5, an exploded view in perspective of the device of FIGS. 1-3, with a cutting grid retained in a releasable frame;

FIG. 6, an exploded view in perspective of the device, with additional fastening elements for the punch;

FIG. 7, a plan view on the underside of the counterpart element of the device, with a punch disposed in captive fashion with fastening elements, in accordance with FIG. 6.

The device shown in the drawings substantially comprises a cutter element 3 and a counterpart element 4, as the drawings show. As FIG. 1 shows, in the embodiment selected here, the cutter element 3 and the counterpart element 4 are supported pivotably counter to one another via a pivot connection 10.

A plurality of intersecting blades 2 combined into a grid are integrated into the cutter element 3.

On the side of the cutter element 3 remote from the counterpart element 4, in the region of the cutting grid, a container 6 is retained releasably by means of a bayonet mount 7.

The counterpart element 4 has a base 9, for placing the device on a work surface (not shown). The base 9 is disposed on the side of the counterpart element 4 remote from the cutter element 3. On the side of the counterpart element 4 toward the cutter element 3, there is a punch 5, on which the onion or similar material to be cut is placed.

The punch 5 has a plurality of projections which provide indentations 8, which correspond with the blades 2 of the cutter element 3 and into which the blades 2 dip when the cutter element 3 is resting on the counterpart element 4. To press the onion 1 all the way through the blades 2, the indentations 8 are embodied as deeper than the height of the blades 2.

As can be seen particularly in FIGS. 4 and 5, the punch 5 is releasably retained on the counterpart element 4 by means of a detent connection 12.

The blades 2 in FIG. 5 are likewise retained in a frame 13, which in turn is disposed releasably in an opening on the cutter element 3.

In the exemplary embodiment of FIGS. 6 and 7, the punch 5 is disposed in captive fashion on the counterpart element 4 by means of fastening elements. The fastening elements are formed by clamping means 16, which are retained on the punch by means of screws 15. For that purpose, each clamping means 16 has one oblong slot 18 for the screw 15, as a result of which the clamping means 16 are held displaceably on the underside of the punch 5. The clamping means 16 can be displaced longitudinally of the oblong slot 18, so that the clamping means 16 extend in part through openings 17 inside the counterpart element 4. If in cutting of the material to be cut, a high pressure is exerted on the punch 5, then the fastening elements in the form of the clamping means 16 with screws 15 retain the punch 5 in captive fashion on the counterpart element 4.

Before the cutting operation, the counterpart element 3 is pivoted upward relative to the counterpart element 4, and the material to be cut is placed on the punch 5. In this position, the container 6 is located on the top side of the cutter element 3. The cutter element 3 is now pressed downward onto the counterpart element 4, whereupon the blades 2 cut the material to be cut into pieces of rectangular cross section. Once the cutter element 3 is resting on the counterpart element 4, the material being cut has been pressed by the punch 5 all the way into the container 6, through the blades 2 in the cutting grid.

The blades 2 of the cutting grid are arranged such that in the event that the cutter element 3 is pivoted again for cutting further onions, the cut material is prevented from falling out of the container 6 through the cutting grid. The quantity of cut material can be checked, because of the transparent container 6.

As soon as there is a desired quantity of cut material in the container 6, the device is turned over into the position shown in FIG. 3, in which the cut material is located on the bottom 11 of the container 6. The container 6 can now be released from the cutter element 3, and if the cut vegetables are not processed immediately, the container can optionally be closed with a cap.

For cleaning the device, its individual parts, such as the cutter element 3, counterpart element 4, punch 5, container 6, blades 2, and frame 13, can be separated from one another.

LIST OF REFERENCE NUMERALS

2 Blades
3 Cutter element
4 Counterpart element
5 Punch
6 Container
7 Bayonet mount
8 Indentations
9 Base
10 Pivot connection
11 Bottom
12 Detent connection
13 Frame
15 Screws
16 Clamping means
17 Opening
18 Oblong slot
30 Upright walls
31 Locking flanges
32 Slots
33 Gaps
34 Peripheral rim
35 ledge

The invention claimed is:

1. A device for cutting fruits and vegetables, comprising:

a cutter member (3) including a plurality of blades (2), a counterpart element (4) against which the cutter member (3) is pressed for cutting the material to be cut, wherein the counterpart element (4) has a punch (5) which presses the material to be cut through the blades (2) of the cutter member (3), said cutter member (3) and said counterpart element (4) comprising boardlike members which are pivotally connected at one end thereof, said counterpart element (4) having a base (9) which rests on a work surface during the cutting action of the device, said cutter member (3) and said counterpart element (4) being supported for pivotal movement relative to one another to allow the blades to pivot downward against the punch (5) to cut a fruit or vegetable placed on the punch (5), a container (6) mounted upside down on the top of the cutter member (3) remote from the counterpart element (4) for receiving the cut material pressed by the punch (5) through the blades (2) of the cutter member (3) with the container (6) upside down and for collecting the cut material when the device is turned over to orient the container (6) upright, said container (6) having an open top mounted adjacent to the blades of the cutter member (3) and a closed bottom (11) projecting upward from the cutter member (3) during the cutting action of the device, a pair of upright walls on the top of the cutter member (3) which form a recessed area in the cutter member (3) extending around the blades for receiving the top of the container (6), a pair of locking flanges projecting outward from the top of the container (6), a pair of slots formed in the upright walls for receiving the locking flanges to secure the top of the container (6) to the cutter member (3), said container (6) being substantially cylindrical and said recessed area formed by the upright walls being substantially circular to allow the container (6) to be fastened to and released from the cutter member (3) by a turning motion about the axis of the container, and said upright walls being arranged to provide gaps along opposite lateral sides of the cutter member (3) for receiving the locking flanges when the top of the container (6) is placed into the recessed area.

2. The device of claim 1, characterized in that the container (6) is releasably retained on the cutter member (3) by a bayonet mount (7) provided by the locking flanges and the slots.

3. The device of claim 1, characterized in that the punch (5) has indentations (8), which correspond with the blades (2) and whose depth is greater than the height of the blades (2).

4. The device of claim 1, characterized in that the blades (2) are mounted in an opening on the cutter element (3).

5. The device of claim 1, characterized in that the container (6) comprises transparent material.

6. The device of claim 1, characterized in that the punch (5) is releasably disposed on the counterpart element (4).

7. The device of claim 6, characterized in that the punch (5) is releasably retained on the counterpart element (4) by a detent connection (12).

8. The device of claim 6, characterized in that the punch (5) is disposed in captive fashion on the counterpart element (4) by fastening elements, so that the punch (5), in cutting of the material to be cut, is retained on the counterpart element (4) counter to the pressure bearing down on the material to be cut.

9. The device of claim 8, characterized in that the fastening elements have at least one clamping means (16) that can be secured with screws (15) or fastening means to the counterpart element (4) and the punch (5).

10. The device of claim 1, characterized in that the blades (2) form a cutting grid.

11. The device of claim 10, characterized in that the punch (5) of the counterpart element (4) has indentations (8) which form a grid like structure corresponding to the cutting grid formed by the blades (2).

12. The device of claim 1, characterized in that the cutter member (3) and the counterpart element (4) are releasably connected to one another.

13. The device of claim 1, characterized in that the blades (2) are retained in a frame (13) disposed releasably on the cutter element (3).

14. The device of claim 1, characterized in that the closed bottom of the container is exposed to allow a user to pivot the cutter member downward by pressing with one hand on the bottom of the container and by pressing with the other hand on a free end of the cutter member.

15. The device of claim 1, characterized in that the container has a peripheral rim projecting outward from the top of the container and the locking flanges project outward from the peripheral rim of the container.

16. A device for cutting fruits and vegetables, comprising:

a cutter member (3) including a plurality of blades (2), a counterpart element (4) against which the cutter member (3) is pressed for cutting the material to be cut, wherein the counterpart element (4) has a punch (5) which presses the material to be cut through the blades (2) of the cutter member (3), said counterpart element (4) having a base (9) adapted to rest on a work surface, said cutter member (3) and said counterpart element (4) being supported for pivotal movement relative to one another to allow the blades to pivot against the punch (5) to cut a fruit or vegetable placed on the punch (5), a container (6) mounted upside down on the top of the cutter member (3) remote from the counterpart element (4) for receiving the cut material pressed by the punch (5) through the blades (2) of the cutter member (3), said container (6) having an open top mounted adjacent to the blades of the cutter member (3) and a closed bottom (11) projecting upward from the cutter member (3) to collect the cut material when the device is turned over, a pair of upright walls on the top of the cutter member (3) which form a recessed area adjacent to the blades for receiving the top of the container (6), a pair of locking flanges projecting outward from the top of the container (6), a pair of slots formed in the upright walls for receiving the locking flanges to secure the top of the container (6) to the cutter member (3), said container (6) being substantially cylindrical and said recessed area formed by the upright walls being substantially circular to allow the container (6) to be fastened to and released from the cutter member (3) by a turning motion about the axis of the container, and said upright walls being arranged to provide gaps along opposite lateral sides of the cutter member (3) for receiving the locking flanges when the top of the container (6) is placed into the recessed area.

17. The device of claim 16, wherein the blades are located in a circular opening within the recessed area of the cutter member (3) between the upright walls.

18. The device of claim 17, wherein the cutter member (3) includes a ledge extending around the circular opening in the recessed area for engaging the top of the container (6) when the container (6) is placed into the recessed area.

19. A device for cutting fruits and vegetables, comprising:

a cutter member (3) including a plurality of intersecting blades (2), a counterpart element (4) including a punch (5) which presses the material to be cut through the intersecting blades (2) of the cutter member (3) when the cutter member (3) and the counterpart element (4) are pressed together, said counterpart element (4) having a base (9) adapted to rest on a work surface, said counterpart element (4) being located below and pivotally connected to the cutter member (3) to allow the blades to pivot downward against the punch (5) on the counterpart element (4) to cut a fruit or vegetable placed on the punch (5), said punch (5) including a plurality of projections for supporting the fruit or vegetable which provide a plurality of indentations (8) corresponding with the intersecting blades (2) of the cutter member (3) for receiving the blades (2) when the cutter member (3) and the counterpart element (4) are pivoted together, a container (6) mounted in an inverted position on the top of the cutter member (3) remote from the counterpart element (4) for receiving the cut material pressed by the punch (5) through the blades (2) of the cutter member (3), said container (6) having an open top mounted adjacent to the blades of the cutter member (3) and a closed bottom (11) projecting upward to collect the cut material when the device is turned over, a pair of upright walls on the top of the cutter member (3) which form a recessed area adjacent to the blades for receiving the top of the container (6), a pair of locking flanges projecting outward from the top of the container (6), a pair of slots formed in the upright walls for receiving the locking flanges to secure the top of the container (6) to the cutter member (3), said container (6) being substantially cylindrical and said recessed area formed by the upright walls being substantially circular to allow the container (6) to be fastened to and released from the cutter member (3) by a turning motion about the axis of the container, and said upright walls being arranged to provide gaps along opposite lateral sides of the cutter member (3) for receiving the locking flanges when the top of the container (6) is placed into the recessed area.

20. The device of claim 19, wherein the blades are located in a circular opening within the recessed area of the cutter member (3) between the upright walls.

21. The device of claim 20, wherein the cutter member (3) includes a ledge extending around the circular opening in the recessed area for engaging the top of the container (6) when the container (6) is placed into the recessed area.

22. A device for cutting fruits and vegetables, comprising:

a cutter member (3) including a plurality of intersecting blades (2), a counterpart element (4) including a punch (5) which presses the material to be cut through the intersecting blades (2) of the cutter member (3) when the cutter member (3) and the counterpart element (4) are pressed together, said cutter member (3) and said counterpart element (4) comprising boardlike members which are pivotally connected at one end thereof, said counterpart element (4) having a base (9) which rests on a work surface during the cutting action of the device, said counterpart element (4) being located below and pivotally connected to the cutter member (3) to allow the blades to pivot downward against the punch (5) on the counterpart element (4) to cut a fruit or vegetable placed on the punch (5), said punch (5) including a plurality of projections for supporting the fruit or vegetable which provide a plurality of indentations (8) corresponding with the intersecting blades (2) of the cutter element (3) for receiving the blades (2) when the cutter element (3) and the counterpart element (4) are pivoted together, a container (6) mounted in an inverted position on the top of the cutter member (3) remote from the counterpart element (4) for receiving the cut material pressed by the punch (5) through the blades (2) of the cutter member (3) with the container (6) in the inverted position and for collecting the cut material when the device is turned over to orient the container (6) in an upright position, said container (6) having an open top mounted adjacent to the blades of the cutter member (3) and a closed bottom (11) projecting upward from the cutter member (3) during the cutting action of the device, a pair of upright walls on the top of the cutter member (3) which form a recessed area in the cutter member (3) extending around the blades for receiving the top of the container (6), a pair of locking flanges projecting outward from the top of the container (6), a pair of slots formed in the upright walls for receiving the locking flanges to secure the top of the container (6) to the cutter member (3), said container (6) being substantially cylindrical and the recessed area formed by the upright walls being substantially circular to allow the container (6) to be fastened to and released from the cutter member (3) by a turning motion about the axis of the container, and said upright walls being arranged to provide gaps along opposite lateral sides of the cutter member (3) for receiving the locking flanges when the top of the container (6) is placed into the recessed area.

23. The device of claim 22, characterized in that the container has a peripheral rim projecting outward from the top of the container and the locking flanges project outward from the peripheral rim of the container.

24. The device of claim 22, characterized in that the closed bottom of the container is exposed to allow a user to pivot the cutter member downward by pressing with one hand on the bottom of the container and by pressing with the other hand on a free end of the cutter member.

25. The device of claim 22, characterized in that the container (6) comprises transparent material.

26. The device of claim 22, characterized in that the punch (5) is releasably disposed on the counterpart element (4).

27. The device of claim 22, characterized in that the intersecting blades (2) are mounted in an opening on the cutter element (3).

28. The device of claim 22, characterized in that the intersecting blades (2) form a cutting grid.

29. The device of claim 28, characterized in that the indentations (8) of the punch (5) are arranged as a grid.

* * * * *